US009284020B2

(12) United States Patent
Lee

(10) Patent No.: US 9,284,020 B2
(45) Date of Patent: Mar. 15, 2016

(54) PORTABLE SECTIONALIZED BOAT

(71) Applicant: Hai-Jung Lee, Kaohsiung (TW)

(72) Inventor: Hai Lee, Kaohsiung (TW)

(73) Assignee: HAI-JUNG LEE, Kaohsiung (TW)

( * ) Notice: Subject to any disclaimer, the term of this patent is extended or adjusted under 35 U.S.C. 154(b) by 11 days.

(21) Appl. No.: 13/837,596

(22) Filed: Mar. 15, 2013

(65) Prior Publication Data

US 2014/0190390 A1 Jul. 10, 2014

(30) Foreign Application Priority Data

Jan. 4, 2013 (TW) ..... 102100208 A

(51) Int. Cl.
*B63B 7/04* (2006.01)
*B63B 7/00* (2006.01)

(52) U.S. Cl.
CPC ... *B63B 7/00* (2013.01); *B63B 7/04* (2013.01); *B63B 2007/006* (2013.01)

(58) Field of Classification Search
CPC ..... B63B 7/00; B63B 7/02; B63B 7/04; B63B 2007/006
USPC ..... 114/343, 352, 353, 354
See application file for complete search history.

(56) References Cited

U.S. PATENT DOCUMENTS

| | | | | | |
|---|---|---|---|---|---|
| 1,948,831 | A | * | 2/1934 | Sobieralski | 114/352 |
| 2,157,186 | A | * | 5/1939 | Pinter, Sr. et al. | 114/344 |
| 2,636,192 | A | * | 4/1953 | May | 114/354 |
| 4,730,573 | A | * | 3/1988 | Koon | 114/353 |

* cited by examiner

*Primary Examiner* — Daniel V Venne
(74) *Attorney, Agent, or Firm* — Muncy, Geissler, Olds & Lowe, P.C.

(57) ABSTRACT

A portable sectionalized boat includes a floating body portion, a base plate portion and a boat shell. The floating body portion is disposed with one or more rows of boat base units, each row including at least one but generally a plurality of boat base units. Several connection holes are disposed on a peripheral edge of the boat base unit. The base plate portion includes a waterproof member and a base plate. The boat shell includes a first outboard plate, a second outboard plate and a lateral plate. The base plate portion and the boat shell are superposed and fixed on the floating body portion.

5 Claims, 9 Drawing Sheets

PORTABLE SECTIONALIZED BOAT

CROSS-REFERENCE TO RELATED APPLICATION

This application claims the benefit of Taiwan Patent Application No. 102100208, filed on Jan. 4, 2013, which is hereby incorporated by reference for all purposes as if fully set forth herein.

BACKGROUND OF THE INVENTION

1. Field of Invention

The present invention relates to a portable sectionalized boat, and more particularly to, a portable sectionalized boat capable of being conveniently accommodated and carried.

2. Related Art

The global climate is anomalous, and flood disasters are frequent no matter whether it is in a village or city. In a city, the population is dense, the land is expensive, and it is very difficult to set aside a space for a rescue ship to prepare for a flood disaster, so when the disaster arrives and the people are trapped, victims can only rely on the rescue organization for salvage, which is actually a slow measure incapable of addressing, a critical situation.

The existing lifeboat design adopts an inflatable air cushion construction. Generally, the lifeboat is made of watertight plastic cloth, and contains a laminar base plate portion and an inflatable loop surrounding the periphery of the base plate portion, so after air is injected into the inflatable loop, the lifeboat may float on the water surface; or an engine is further installed at the rear end of the lifeboat so as to drive a propeller, and rescuers ride on the lifeboat to carry out a rescue task.

The foregoing air cushion lifeboat may be provided for rescuers to be engaged in a water rescue task, but an inflatable boat body made of plastic cloth is used in the lifeboat, and is easily pierced by a sharp object or damaged due to ground rubbing in use, so that the lifeboat deflates and cannot be used. Therefore, in a flood disaster area where a debris flow occurs or a flood disaster area where numerous drifting objects float on the water, the air cushion lifeboat is usually inapplicable.

Moreover, an ordinary lifeboat has problems of inconvenience for accommodation and carrying, namely, it often occupies lots of space for accommodation and needs assistance from persons for carrying.

SUMMARY OF THE INVENTION

The present invention provides a portable sectionalized boat, to further improve the convenience for carrying and accommodating the portable sectionalized boat through a sectionalized floating body portion.

The present invention proposes a portable sectionalized boat, including a floating body portion, a base plate portion and a boat shell. The floating body portion is disposed with one or more rows of boat base units, each row including at least one but generally a plurality of boat base units. Several connection holes are disposed on a peripheral edge of the boat base unit. The base plate portion includes a waterproof member and a base plate. The boat shell includes a first outboard plate, a second outboard plate and a lateral plate. The base plate portion and the boat shell are superposed and fixed on the floating body portion.

In an embodiment of the present invention, the floating body portion is formed by combing the boat base units opposite in pairs into one or more rows.

In an embodiment of the present invention, the boat base units of the floating body portion are superposed with each other for accommodation.

In an embodiment of the present invention, the boat base unit is disposed with a concave portion, and the concave portion of the boat base unit is formed into a base depressed upward, namely, the top wall is deep at the front end and gradually shallows toward the rear end; and is approximately a triangular or sectorial groove in the longitudinal section view while is generally a rectangular groove in the plan view.

In an embodiment of the present invention, a support rod is further disposed between the floating body portion and another floating body portion such as to keep balance of the two floating body portions.

In the present invention, a boat body structure which is conveniently sectionalized and accommodated is adopted, so in a non-use state, the portable sectionalized boat may be sectionalized and accommodated, which is convenient to carry. Moreover, in a portable sectionalized boat including four boat base units in a single box shape disclosed in this application, every two boxes are formed into a group through bolt connection, a main boat body is formed with channel steel through bolt connection in the middle of the two groups of boat base units, a waterproof member and a base plate formed by splicing a plurality of checkered plates are installed above the main boat body so as to form a deck in combination with a zirconium chain, and a hamper structure is installed at the peripheral edge of the deck so as to increase the overall strength.

BRIEF DESCRIPTION OF THE DRAWINGS

The present invention will become more fully understood from the detailed description given herein below for illustration only, and thus are not limitative of the present invention, and in which.

DETAILED DESCRIPTION OF THE INVENTION

In order to make the aforementioned features and advantages of the present invention more comprehensible, embodiments are illustrated in detail hereinafter with reference to the accompanying drawings.

Figure 1:
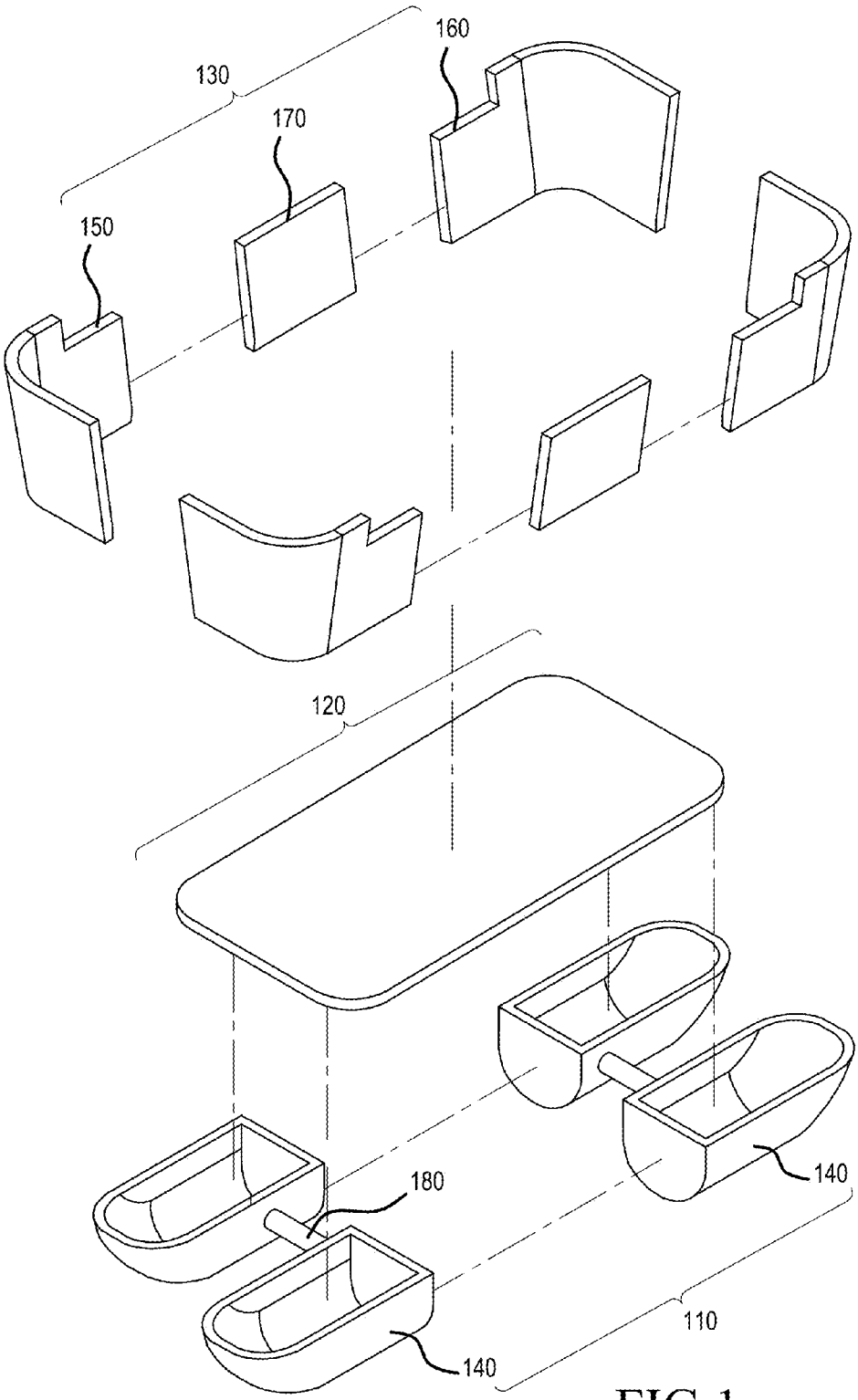
FIG. 1 is a structural decomposition of a portable sectionalized boat according to the present invention.
Figure 2:
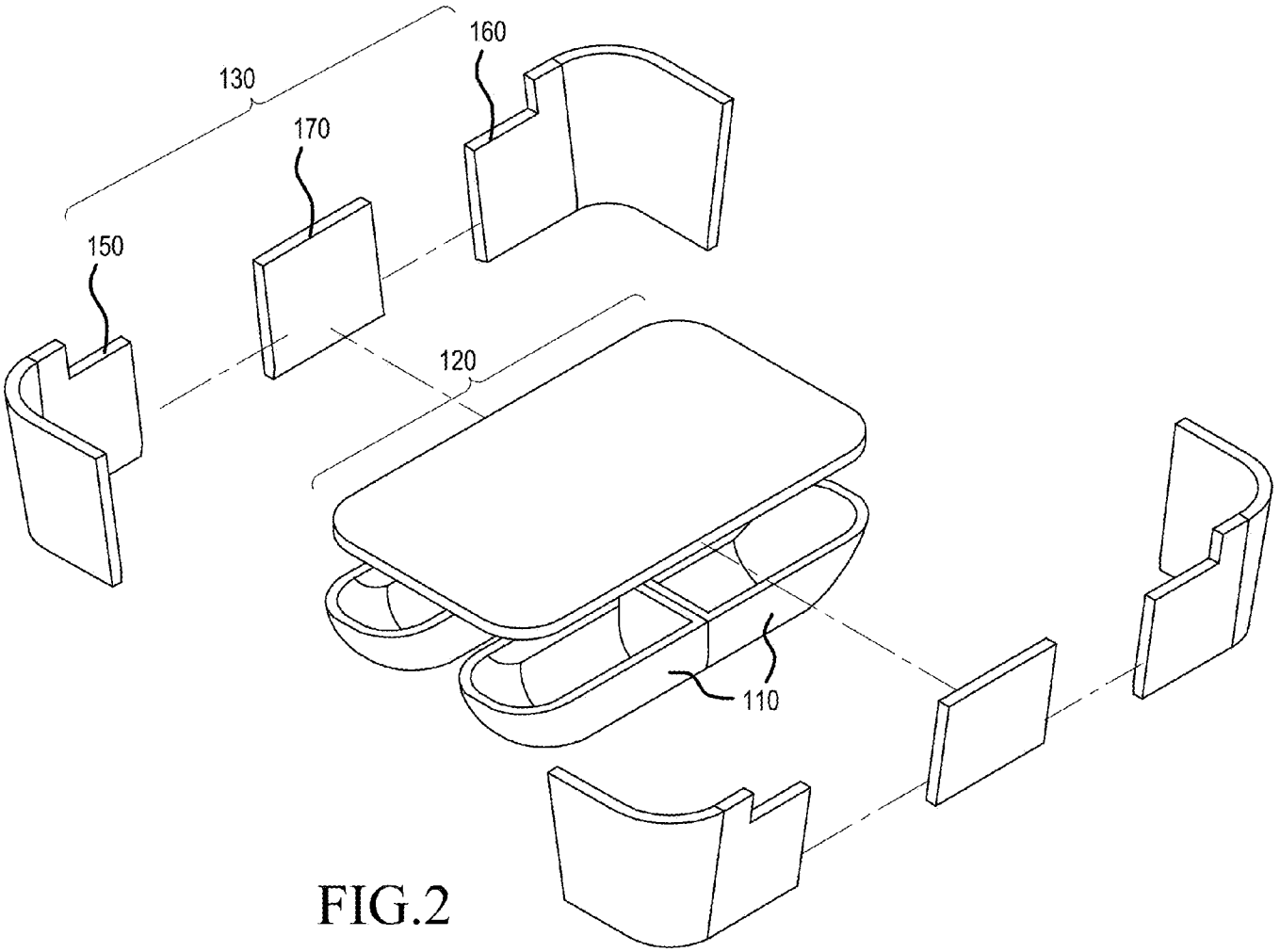
FIG. 2 is a structural combination of a portable sectionalized boat according to the present invention.
Figure 3A:
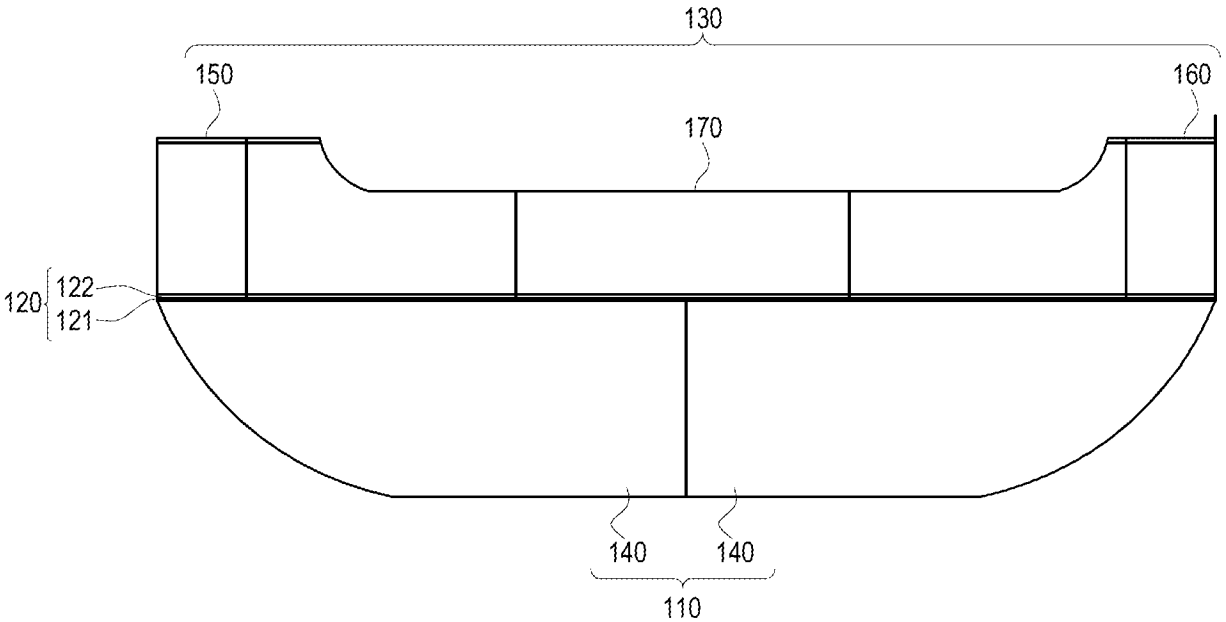
FIG. 3A is a schematic appearance diagram of an embodiment of a portable sectionalized boat according to the present invention.
Figure 3B:
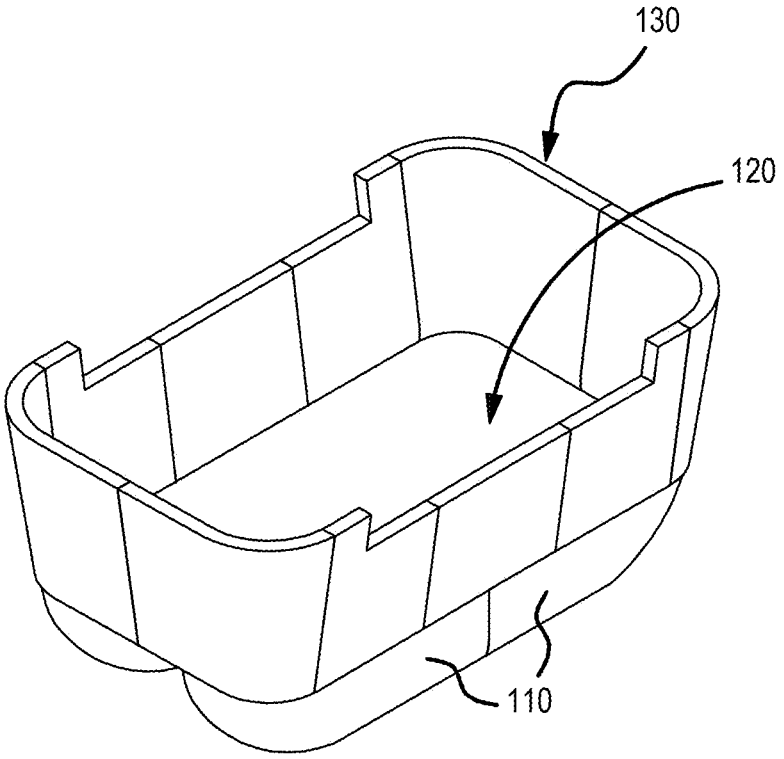
FIG. 3 B is another view of FIG. 3A.
Figure 4:
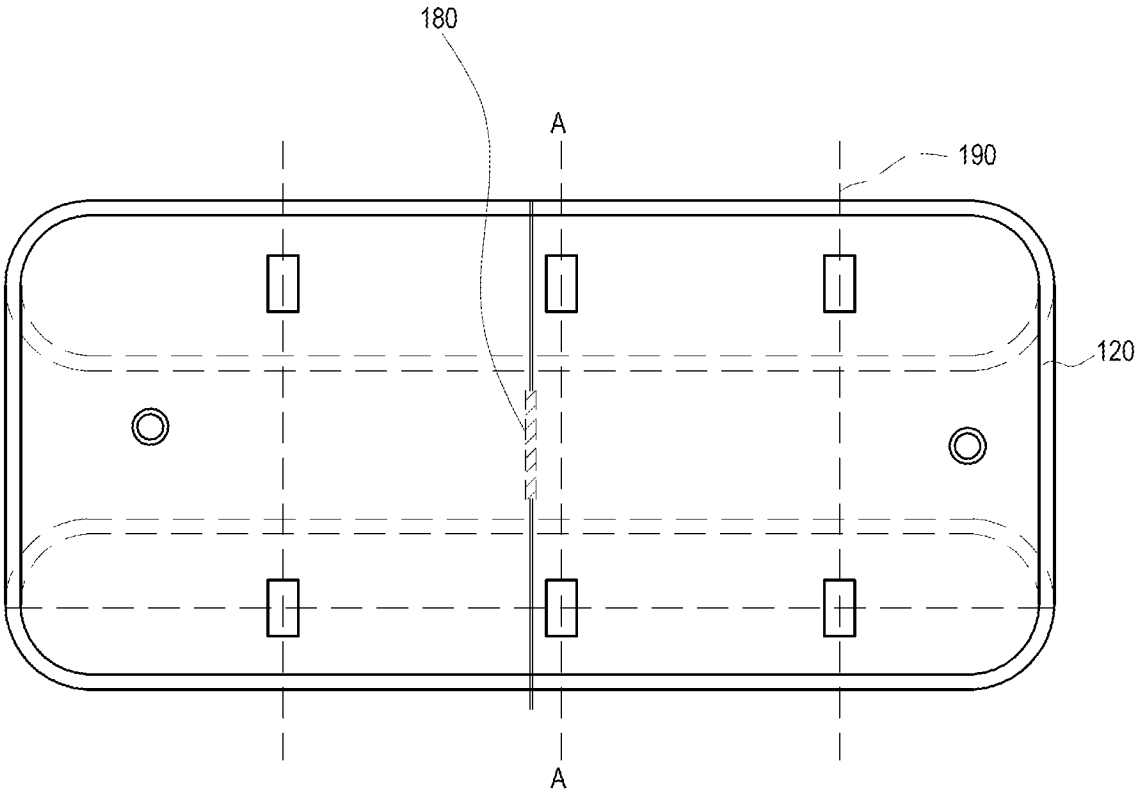
FIG. 4 is a top view of an embodiment of a portable sectionalized boat according to the present invention.
Figure 5:
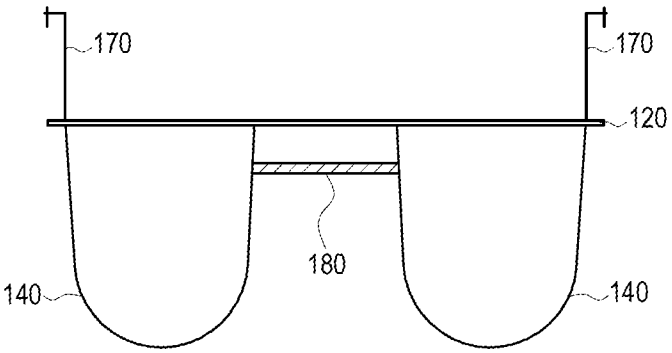
FIG. 5 is a side view of an embodiment of a portable sectionalized boat according to the present invention.
Figure 6:
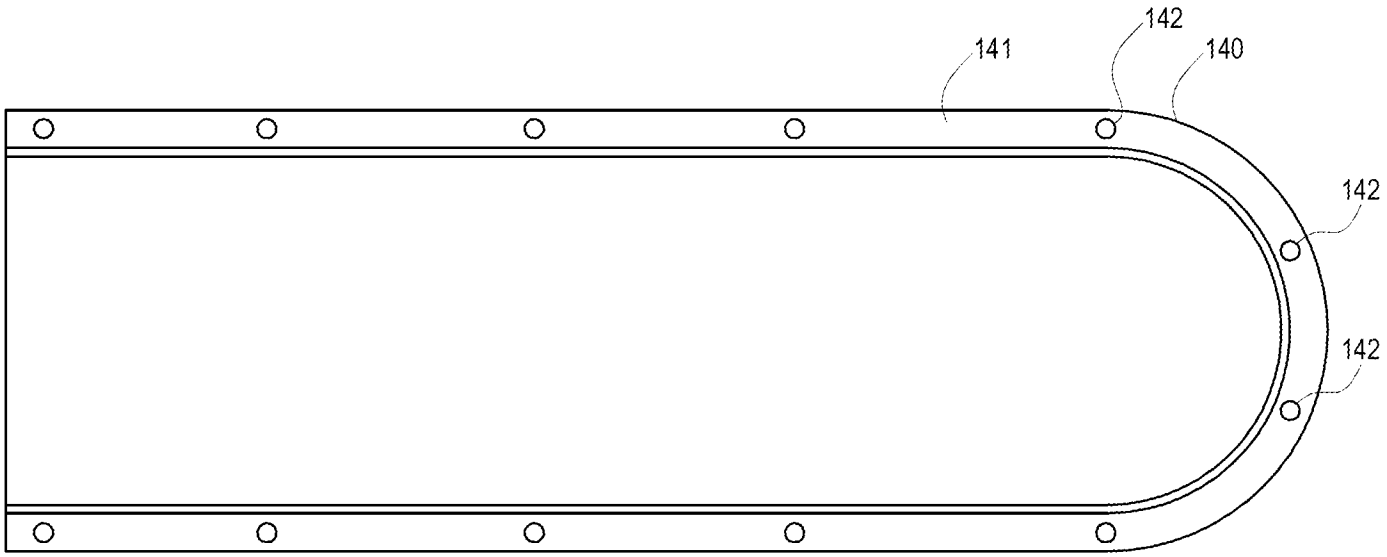
FIG. 6 is a schematic partial diagram of a boat base unit of a portable sectionalized boat according to the present invention.
Figure 7:
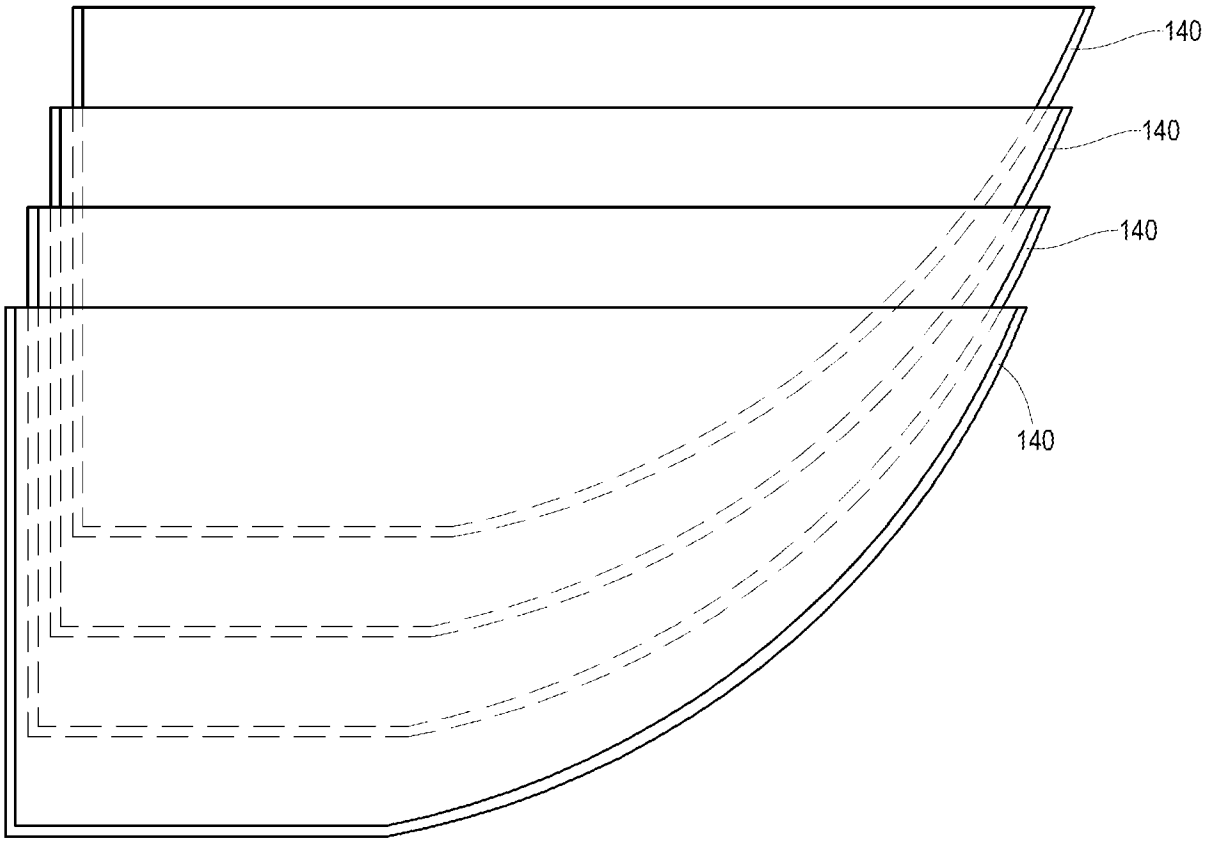
FIG. 7 is a schematic superposition diagram of a portable sectionalized boat according to the present invention.
Figure 8:
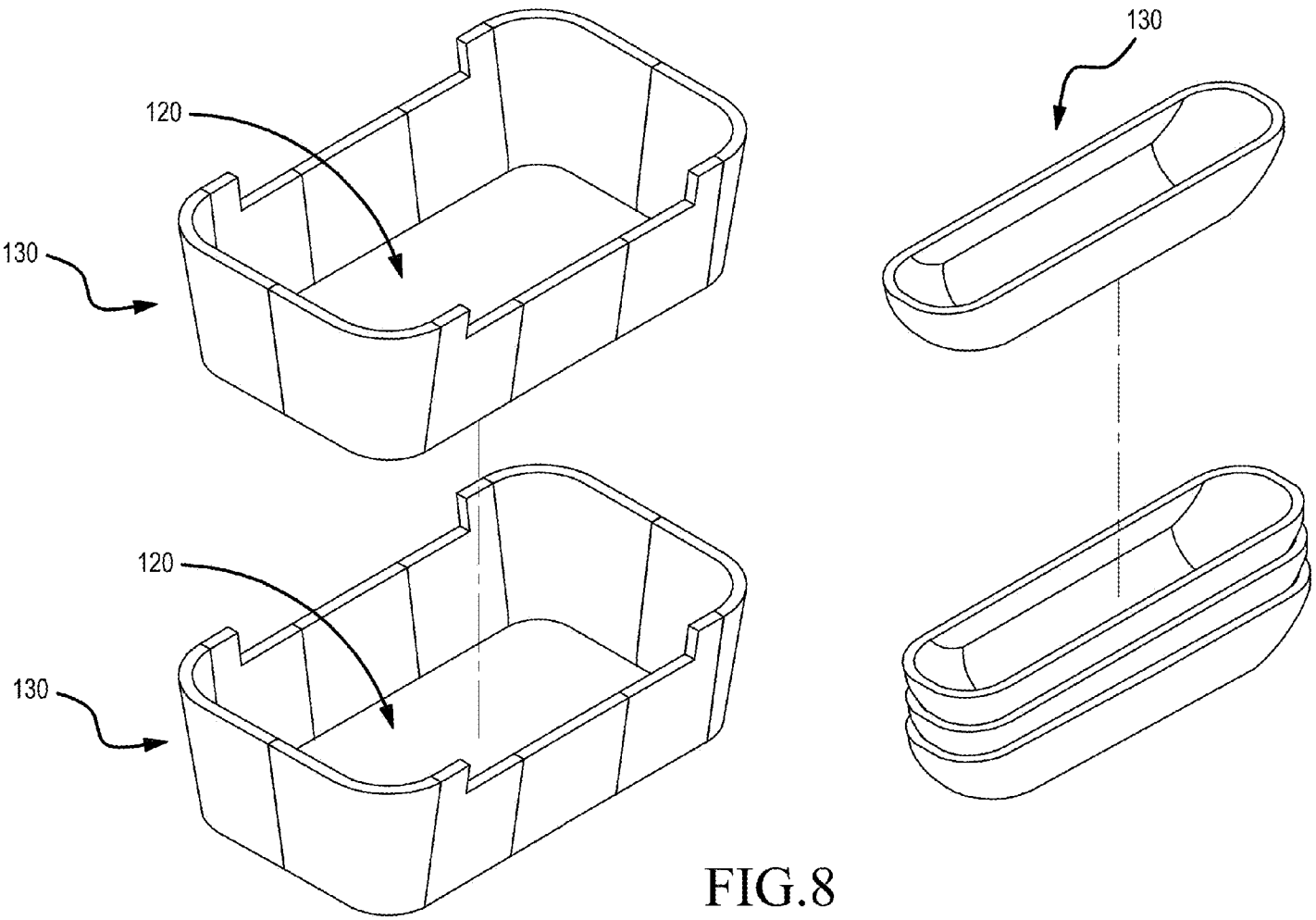
FIG. 8 is another schematic superposition diagram of a portable sectionalized boat according to the present invention.

Referring to FIG. 1 to FIG. 8, FIG. 1 is a structural decomposition of a portable sectionalized boat according to the present invention. FIG. 2 is a structural combination of a portable sectionalized boat according to the present invention. FIG. 3A is a schematic appearance diagram of an embodiment of a portable sectionalized boat according to the present invention. FIG. 3 B is another view of FIG. 3A. FIG. 4 is a top view of an embodiment of a portable sectionalized boat according to the present invention. FIG. 5 is a side view of an embodiment of a portable sectionalized boat according to the present invention. FIG. 6 is a schematic partial diagram of a boat base unit of a portable sectionalized boat according to the present invention. FIG. 7 is a schematic superposition diagram of a portable sectionalized boat according to the present invention. FIG. 8 is another schematic superposition diagram of a portable sectionalized boat according to the present invention.

In FIG. 1~3B, the portable sectionalized boat includes a floating body portion 110, a base plate portion 120 and a boat shell 130. The floating body portion 110 is disposed with one or more rows of boat base units 140, each row including at least one but generally a plurality of boat base units 140, and a support rod which is a steel bar 180 is further disposed between one boat base unit 140 and another boat base unit 140 so as to keep balance of the two boat base units 140. The floating body portion 110 is formed by combining the boat base units 140 opposite in pairs into one or more rows, several connection holes 142 are disposed on a peripheral edge 141 of the boat base unit 140 (referring to FIG. 5), and the boat base units 140 are superposed with each other so as to be conveniently accommodated (referring to FIG. 7 and/or FIG. 8). Furthermore, the boat base unit 140 is disposed with a concave portion, and the concave portion of the boat base unit 140 is formed into a base depressed upward, namely, the top wall is deep at the front end and gradually shallows toward the rear end; and is approximately a triangular or sectorial groove in the longitudinal section view while is generally a rectangular groove in the plan view.

The base plate portion 120 includes a waterproof member 121 and a base plate 122, and the base plate portion 120 and several boat base units 140 are arranged into the maximum range of the floating body portion 110 (referring to FIG. 4). A zirconium chain 190 is further added to the floating body portion 110 to increase stability of the floating body portion 110.

The boat shell 130 includes a first outboard plate 150, a second outboard plate 160 and a lateral plate 170. The boat shell 130 is at a vertical angle relative to the base plate portion 120 (referring to FIG. 5). The base plate portion 120 and the boat shell 130 are superposed and fixed on the floating, body portion 110 by use of screws or mortises and tenons.

Although the present invention has been disclosed through the foregoing embodiments, they are not intended to limit the present invention. Equivalent replacements of variations and modifications made by persons skilled in the art without departing from the spirit and the scope of the present invention still fall within the protection scope of the present invention.

What is claimed is:

1. A portable sectionalized boat, comprising:

a floating body portion, disposed with at least one row of boat base units, each of the at least one row comprising at least one boat base unit, wherein several connection holes are disposed on a peripheral edge of the boat base unit;

a base plate portion, comprising a waterproof member and a base plate; and a boat shell, comprising a first outboard plate, a second outboard plate and a lateral plate, wherein the base plate portion and the boat shell are superposed and fixed on the floating body portion.

2. The portable sectionalized boat according to claim 1, wherein the floating body portion is formed by combining the boat base units opposite in pairs into one row.

3. The portable sectionalized boat according to claim 1, wherein the boat base units of the floating body portion are superposed with each other for accommodation.

4. The portable sectionalized boat according to claim 1, wherein the boat base unit is disposed with a concave portion, and the concave portion is a groove in a longitudinal section view while having a rectangular shape in a plan view.

5. The portable sectionalized boat according to claim 1, wherein a support rod is disposed between the floating body portion and another floating body portion to keep balance of the two floating body portions.

* * * * *